US009765933B2

(12) United States Patent
Lambrix et al.

(10) Patent No.: US 9,765,933 B2
(45) Date of Patent: Sep. 19, 2017

(54) CNG DISPENSER

(71) Applicant: BPC Acquisition Company, Spring Lake, MI (US)

(72) Inventors: Sarah Ann Lambrix, Grand Haven, MI (US); Chad Robert Paffhausen, Spring Lake, MI (US); Adam Kenneth Simon, Norton Shores, MI (US); Jonathan M Rathbun, Belmont, MI (US)

(73) Assignee: BPC Aquisition Company, Spring Lake, MI (US)

( * ) Notice: Subject to any disclaimer, the term of this patent is extended or adjusted under 35 U.S.C. 154(b) by 469 days.

(21) Appl. No.: 14/210,954

(22) Filed: Mar. 14, 2014

(65) Prior Publication Data

US 2014/0263420 A1 Sep. 18, 2014

Related U.S. Application Data

(60) Provisional application No. 61/793,754, filed on Mar. 15, 2013.

(51) Int. Cl.
*F17C 7/00* (2006.01)
*F17C 5/00* (2006.01)

(52) U.S. Cl.
CPC ..... *F17C 7/00* (2013.01); *F17C 5/007* (2013.01); *F17C 2205/0326* (2013.01); *F17C 2205/0329* (2013.01); *F17C 2205/0332* (2013.01); *F17C 2205/0341* (2013.01); *F17C 2205/0367* (2013.01); *F17C 2205/0376* (2013.01); *F17C 2221/033* (2013.01); *F17C 2223/0123* (2013.01); *F17C 2223/036* (2013.01); *F17C 2225/0123* (2013.01); *F17C 2225/036* (2013.01); *F17C 2227/043* (2013.01); *F17C 2227/044* (2013.01); *F17C 2250/032* (2013.01);
(Continued)

(58) Field of Classification Search
CPC ..... F17C 5/007; F17C 5/06; F17C 2221/033; F17C 2223/0123; F17C 2223/036; F17C 2225/0123; F17C 2225/036; F17C 2227/043; F17C 2250/032; F17C 2250/043; F17C 2250/0626; F17C 2265/065
USPC ..... 141/83, 94–95, 197, 301–302
See application file for complete search history.

(56) References Cited

U.S. PATENT DOCUMENTS 5,311,851 A * 5/1994 Wright, Jr. ..... F02D 17/04 123/198 D
5,409,046 A * 4/1995 Swenson ..... F17C 9/02 141/11
(Continued)

*Primary Examiner* — Nicolas A Arnett
(74) *Attorney, Agent, or Firm* — Price Heneveld LLP

(57) ABSTRACT

According to one embodiment, a CNG dispenser is provided that includes a user-actuatable button for allowing selection of a pressure to which to fill a vehicle tank with CNG, and a controller for opening a high pressure fill valve to dispense high pressure CNG into the vehicle tank while monitoring the pressure of the vehicle tank until the pressure reaches the user-selected pressure. According to another embodiment, the controller is operable in a selected one of two modes of operation. The two modes of operation include a one-pressure bank operation mode in which only the input of a high pressure fill valve is coupled to a CNG supply line, and a three-pressure bank operation mode in which the inputs of each of three fill valves are coupled to respective CNG supply lines. A graphic fuel gage may be provided on the dispenser payment terminal screen.

8 Claims, 8 Drawing Sheets

(52) U.S. Cl.
CPC .. *F17C 2250/036* (2013.01); *F17C 2250/043* (2013.01); *F17C 2250/0439* (2013.01); *F17C 2250/0443* (2013.01); *F17C 2250/0452* (2013.01); *F17C 2250/0478* (2013.01); *F17C 2250/0626* (2013.01); *F17C 2260/025* (2013.01); *F17C 2265/065* (2013.01); *F17C 2270/0139* (2013.01)

(56) References Cited

U.S. PATENT DOCUMENTS 5,454,408 A * 10/1995 DiBella ..... F04B 9/1176 141/18
5,458,167 A * 10/1995 Schultz ..... F17C 5/06 141/197
5,479,966 A * 1/1996 Tison ..... F17C 5/06 141/12
5,676,180 A * 10/1997 Teel ..... F17C 5/06 137/267
5,868,176 A * 2/1999 Barajas ..... F17C 13/02 141/198
5,884,675 A * 3/1999 Krasnov ..... F17C 5/06 141/18
7,305,865 B2 * 12/2007 Kralick ..... H01M 8/04223 429/425
7,415,995 B2 * 8/2008 Plummer ..... F17C 6/00 141/192
8,555,206 B2 * 10/2013 Pederson ..... G05B 19/409 715/748
2005/0016185 A1 * 1/2005 Emmer ..... F17C 5/007 62/50.1
2005/0170226 A1 * 8/2005 Kralick ..... H01M 8/04223 73/23.2
2006/0005895 A1 * 1/2006 Gram ..... F04B 5/02 141/104
2007/0034283 A1 * 2/2007 Plummer ..... F17C 6/00 141/234
2007/0275615 A1 * 11/2007 Norton ..... A63B 41/12 441/90
2008/0299634 A1 * 12/2008 Lutz ..... C12M 21/04 435/167
2009/0164933 A1 * 6/2009 Pederson ..... G05B 19/409 715/772
2014/0261882 A1 * 9/2014 Lambrix ..... B67D 7/04 141/94
2015/0083273 A1 * 3/2015 Thiessen ..... F17C 5/06 141/94
2015/0308622 A1 * 10/2015 Koonce ..... F17C 5/06 141/4

* cited by examiner

CNG DISPENSER

CROSS-REFERENCE TO RELATED APPLICATION

This application claims priority to and the benefit under 35 U.S.C. §119(e) of U.S. Provisional Patent Application No. 61/793,754, filed on Mar. 15, 2013, entitled "IMPROVED CNG DISPENSER," by Sarah Ann Lambrix et al., the entire disclosure of which is incorporated herein by reference.

BACKGROUND OF THE INVENTION

The present invention generally relates to dispensers for dispensing compressed natural gas (CNG) to vehicles.

SUMMARY OF THE INVENTION

According to an embodiment of the present invention, a CNG dispenser is provided comprising: a cabinet; a fill hose extending from the cabinet; a pressure sensor disposed to sense a pressure within the fill hose that corresponds to a pressure of a vehicle tank when the fill hose is coupled to the vehicle tank; a high pressure fill valve disposed between a high pressure CNG supply line and the fill hose; at least one user-actuatable button disposed on the cabinet for allowing a user to select a pressure to which to fill the vehicle tank with CNG; and a controller coupled to the at least one user-actuatable button, the pressure sensor, and the high pressure fill valve for opening the high pressure fill valve to dispense high pressure CNG into the vehicle tank while monitoring the pressure of the vehicle tank as sensed by the pressure sensor until the pressure reaches the user-selected pressure.

According to another embodiment of the present invention, a CNG dispenser is provided comprising: a cabinet; a fill hose extending from the cabinet; a pressure sensor disposed to sense a pressure within the fill hose that corresponds to a pressure of a vehicle tank when the fill hose is coupled to the vehicle tank; a low pressure fill valve having an input configured to be coupled to a lower pressure CNG supply line, and an output coupled to the fill hose; a medium pressure fill valve having an input configured to be coupled to a medium pressure CNG supply line, and having an output coupled to the fill hose; a high pressure fill valve having an input configured to be coupled to a high pressure CNG supply line, and having an output coupled to the fill hose; and a controller coupled to the pressure sensor, and the low, medium, and high pressure fill valves, wherein the controller is operable in a selected one of two modes of operation that may be selected by an operator of a filling station where the CNG dispenser is located, the two modes of operation include a one-pressure bank operation mode in which only the input of the high pressure fill valve is coupled to a CNG supply line, and a three-pressure bank operation mode in which the inputs of each of the fill valves are coupled to respective CNG supply lines.

These and other features, advantages, and objects of the present invention will be further understood and appreciated by those skilled in the art by reference to the following specification, claims, and appended drawings.

DETAILED DESCRIPTION OF THE EMBODIMENTS

Figure 1:
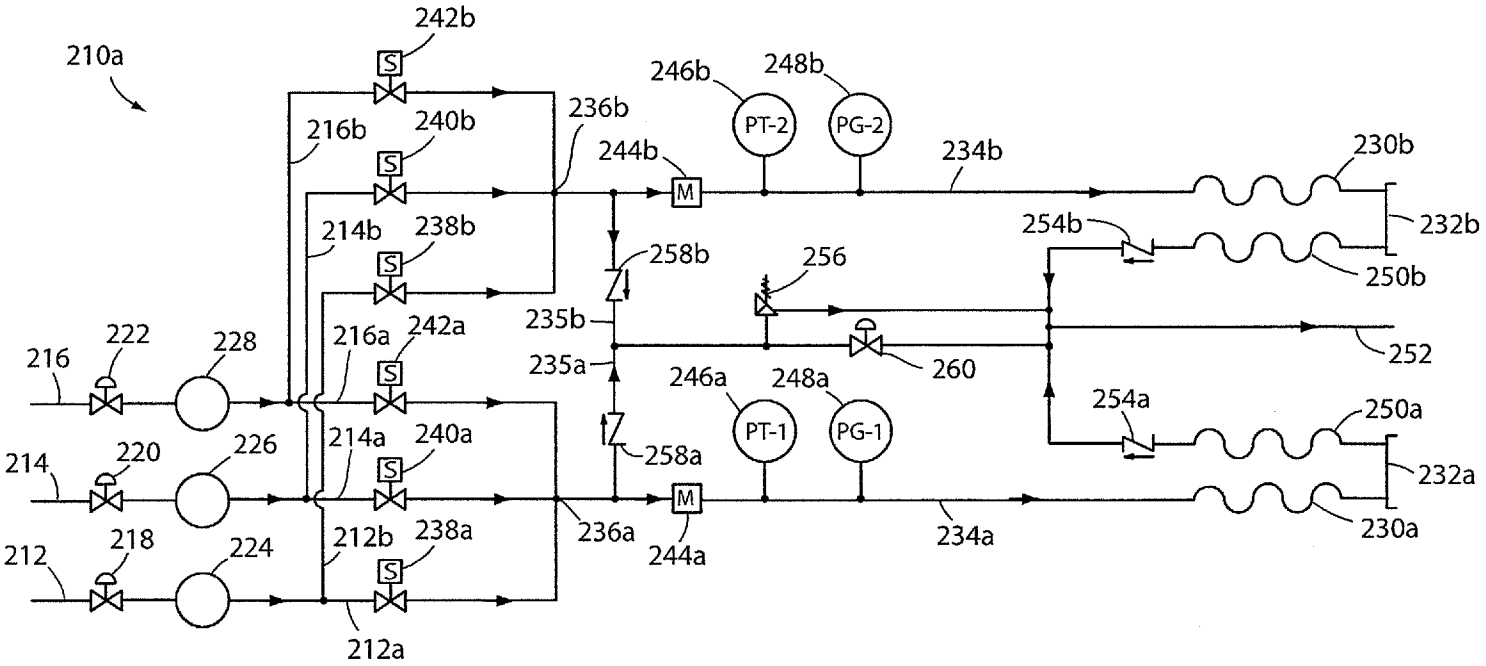
FIG. 1 is a hydraulic flow diagram in schematic form of CNG flow control components of a dispenser according to some of the embodiments.

Reference will now be made in detail to the present preferred embodiments of the invention, examples of which are illustrated in the accompanying drawings. Wherever possible, the same reference numerals will be used throughout the drawings to refer to the same or like parts. In the drawings, the depicted structural elements are not to scale and certain components are enlarged relative to the other components for purposes of emphasis and understanding.

Figure 3:
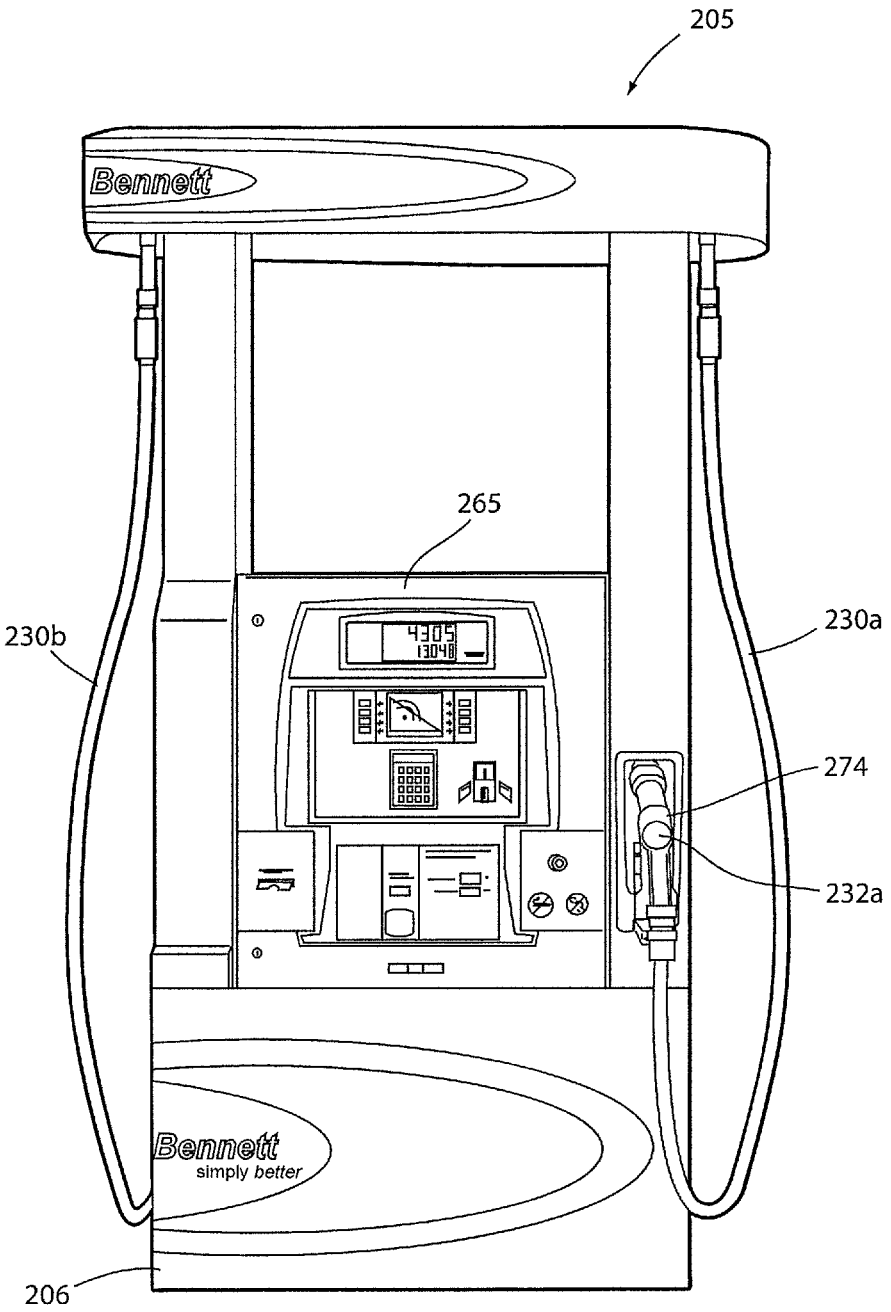
FIG. 3 is an elevational view of a front of a CNG dispenser in which the embodiments described herein are implemented.

FIG. 1 is a hydraulic flow diagram showing the CNG hydraulic components 210*a* of a dispenser 205 (FIG. 3). There are typically two to four lines that run between a dispenser and the pressure banks of a natural gas farm where the CNG is typically stored in one or three pressure banks. In typical CNG dispensers that are used with a one-pressure bank system, these lines include a vent line 252 and a supply line 216 that supplies CNG at a single high pressure to the dispenser. If the CNG dispensers are used with a three-pressure bank system, these lines include a vent line 252, and a first supply line 212 that supplies CNG at a first pressure to the dispenser, a second supply line 214 that supplies CNG at a second pressure (higher than the first pressure), and a third supply line 216 that supplies CNG at a third pressure (higher than the first and second pressures). Natural gas farms often store CNG at multiple pressures due to the cost of storing CNG at the high pressures (i.e., 3000 to 3600 psi) required for vehicles. More specifically, a natural gas farm may store CNG in a first pressure bank at 2000 psi, in a second pressure bank at 3000 psi, and in a third pressure bank at 4000 psi. When filling a vehicle tank up to 3600 psi, for example, CNG is first drawn off the first pressure bank through first supply line 212 until the vehicle tank is partially filled at 2000 psi, then CNG is drawn off the second pressure bank through second supply line 214 until the vehicle tank is partially filled at 3000 psi, and then CNG is drawn off the third pressure bank through third supply line

216 until the vehicle tank is completely filled at 3600 psi. The actual pressure at which the vehicle is filled may depend on ambient temperature as discussed further below. Because the CNG in the lower-pressure first and second pressure banks costs less to supply, the cost of filling a vehicle tank is reduced by filling the vehicle as much as possible by initially using the lower pressure first and second pressure banks to partially fill the vehicle tank.

Some of the embodiments described below provide a CNG dispenser 205 that may be configured with software to operate with either a one-pressure bank system or a three-pressure bank system. In this manner, a filling station would not have to switch CNG dispensers 205 when changing from a one-bank system to a three-bank system or vice versa.

Dispenser 205 further includes manual shut-off valves 218, 220, and 222 on supply lines 212, 214, and 216, respectively. Each of supply lines 212, 214, and 216 further includes a filter 224, 226, and 228, respectively. After filtration, each of supply lines 212, 214, and 216 is split into first and second branches 212*a* and 212*b*, 214*a* and 214*b*, and 216*a* and 216*b*, where the two branches are provided for the two vehicle fill hoses 230*a* and 230*b* that are positioned on either side of dispenser 205 (see also FIG. 3). In a typical CNG dispenser 205, one fill hose 230*a* is configured for supplying pressure to 3000 psi and the other fill hose 230*b* is configured for supplying pressure to 3600 psi. In some cases, a nozzle on fill hose 230*a* is shaped differently than a nozzle on fill hose 230*b*. For example, fill hose 230*a* may have a nozzle that is shaped to fit a vehicle fill connector of a vehicle that runs on CNG at a pressure of 3000 psi while fill hose 230*b* may have a nozzle that is shaped to fit a vehicle fill connector of a vehicle that runs on CNG at a pressure of 3600 psi. This is to prevent users from inadvertently using the wrong fill hose and filling their tank to the wrong pressure. However, having different fill hoses that operate at different predetermined pressures limits the number of available fill hoses at a filling station and makes it difficult for a user to pull up to a dispenser that may be available on one side only to find out that the fill hose needed is already in use at the other side of the dispenser 205. One embodiment addresses this problem by providing a CNG dispenser 205 that allows the user to select a pressure to be delivered through any one fill hose 230*a*, 230*b*. In other words, dispenser 205 may be configured to allow selection of a "grade" of CNG having either 3000 psi or 3600 psi to be dispensed through a single fill hose 230*a*, 230*b*. In this regard, fill hose 230*a* may have a nozzle 232*a* that is shaped to fit either of the available vehicle fill connector styles, and fill hose 230*b* may have a nozzle 232*b* that is also shaped to fit either of the available vehicle fill connector styles.

The first branches 212*a*, 214*a*, and 216*a* of supply lines 212, 214, and 216 include a respective low pressure fill valve 238*a*, medium pressure fill valve 240*a*, and high pressure fill valve 242*a*. Likewise, the second branches 212*b*, 214*b*, and 216*b* of supply lines 212, 214, and 216 include a respective low pressure fill valve 238*b*, medium pressure fill valve 240*b*, and high pressure fill valve 242*b*. The outputs of valves 238*a*, 240*a*, and 242*a* are coupled to a first manifold 236*a* that connects first branches 212*a*, 214*a*, and 216*a* with a first fill line 234*a*, which is coupled to first fill hose 230*a*. The outputs of valves 238*b*, 240*b*, and 242*b* are coupled to a second manifold 236*b* that connects second branches 212*b*, 214*b*, and 216*b* with a second fill line 234*b*, which is coupled to second fill hose 230*b*.

Figure 2:
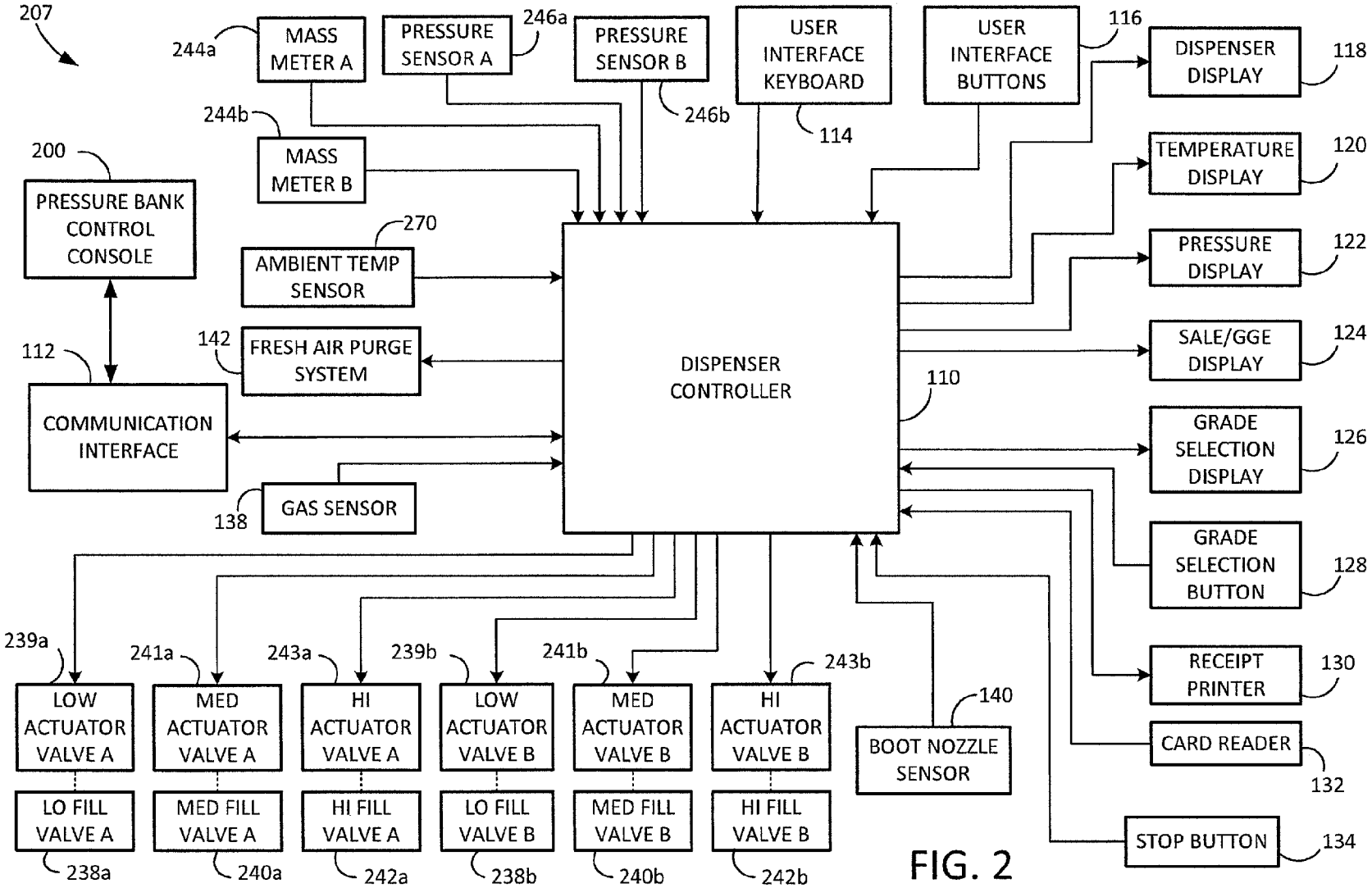
FIG. 2 is an electrical circuit diagram in block form of electrical components of a dispenser according to some of the embodiments.

Each of valves 238*a*, 240*a*, 242*a*, 238*b*, 240*b*, and 242*b* are selectively and independently opened and closed under control of a dispenser controller 110 (FIG. 2). In this manner, only one of valves 238*a*, 240*a*, and 242*a* is opened at any one time to supply CNG at selected pressure through first fill hose 230*a*. Similarly, only one of valves 238*a*, 240*a*, and 242*a* is opened at any one time to supply CNG at a selected pressure through second fill hose 230*a*.

Valves 238*a*, 240*a*, 242*a*, 238*b*, 240*b*, and 242*b* may be pneumatically-actuated hydraulic valves, which are controlled by controller 110 via respective actuator valves 239*a*, 241*a*, 243*a*, 239*b*, 241*b*, and 243*b* (FIG. 2). These actuator valves 239*a*, 241*a*, 243*a*, 239*b*, 241*b*, and 243*b* may be electrically-actuated pneumatic valves. The use of such a valve system allows the pneumatically-actuated hydraulic valves 238*a*, 240*a*, 242*a*, 238*b*, 240*b*, and 242*b* to be located in the hazardous area of dispenser 205 and the electrically-actuated pneumatic actuator valves 239*a*, 241*a*, 243*a*, 239*b*, 241*b*, and 243*b* to be located in the electrical portion of a cabinet 206 (FIG. 3) of dispenser 205, thus isolating the hazardous area from any electrical lines. Alternatively, fill valves 238*a*, 240*a*, 242*a*, 238*b*, 240*b*, and 242*b* may be electrically-operated explosion proof valves thereby eliminating the need for the electrically-actuated pneumatic actuator valves 239*a*, 241*a*, 243*a*, 239*b*, 241*b*, and 243*b*.

A first meter 244*a* is provided in fill line 234*a* for measuring the CNG flowing through it. A second meter 244*b* is provided in fill line 234*b* for measuring the CNG flowing through it. As discussed further below, meters 244*a* and 244*b* are electrically coupled to dispenser controller 110 (FIG. 2), which reads meter data during various periods of operation.

A first digital pressure sensor 246*a* is also provided in first fill line 234*a* proximate first vehicle fill hose 230*a* for providing pressure readings to controller 110. When filling a vehicle tank using first fill hose 230*a*, controller 110 may first reads a selected pressure as determined by which grade the user selected by pressing a grade select button 128 (if provided) corresponding to the desired pressure. Controller 110 then opens first low pressure fill valve 238*a* while keeping closed first medium pressure valve 240*a* and first high pressure valve 242*a* such that CNG from the low pressure bank supplied via first supply line 212 is dispensed to the vehicle tank. Controller 110 monitors the pressure readings from first digital pressure sensor 246*a*, which correspond to the pressure in the vehicle tank when filling the vehicle tank. Thus, controller 110 may monitor the progress of the filling of the vehicle tank and when the pressure reaches a first pressure level corresponding to the low pressure level supplied from first supply line 212 (i.e., 2000 psi), controller 110 may close first low pressure fill valve 238*a* and open first medium pressure valve 240*a* while keeping closed first high pressure valve 242*a* such that CNG from the medium pressure bank supplied via second supply line 214 is dispensed to the vehicle tank. Then, when the pressure reaches a second pressure level corresponding to the medium pressure level supplied from second supply line 214 (i.e., 3000 psi), controller 110 may close first medium pressure fill valve 240*a*. If the pressure selected by the user is 3000 psi, the sale is completed. On the other hand, if the pressure selected by the user is 3600 psi, controller 110 opens first high pressure valve 242*a* while keeping closed first low pressure valve 238*a* and first medium pressure valve 240*a* such that CNG from the high pressure bank supplied via third supply line 216 is dispensed to the vehicle tank. Once the pressure reaches a third pressure level corresponding to the user-selected pressure, controller 110 closes first high pressure valve 242*a* and completes the sale.

It will be apparent to those skilled in the art that the second branches with associated fill valves 238*b*, 240*b*, and 242*b* that are used to feed second fill line 234*b* and fill hose 230*b* may be operated in the same manner.

A digital temperature sensor 270 (FIG. 2) reads the ambient temperature of the outside air surrounding dispenser 205 and supplies the temperature data to controller 110. Controller 110 may use the ambient temperature reading to adjust the pressure to which the vehicle tank is to be filled. For example, if the proper pressure for a vehicle is 3600 psi at 60° F., controller 110 reduces the pressure at colder temperatures such that the CNG does not over-pressurize as it warms up. Likewise, controller 110 increases the pressure at warmer temperatures. Controller 110 may display the ambient temperature on ambient temperature display 120.

As noted above, the system further includes vent line 252 (FIG. 1), which connects to vent hoses 250*a* and 250*b* extending from respective nozzles 232*a* and 232*b* via check valves 254*a* and 254*b*.

Dispenser 205 further includes a pressure relief valve 256, which is coupled to pressure relief lines 235*a* and 235*b* branching off of fill lines 234*a* and 234*b*, respectively. Pressure relief valve 256 may open and vent to vent line 252 when the pressure in either of pressure relief lines 235*a* and 235*b* exceeds a predetermined pressure of, for example, 4500 psi. Pressure relief lines 235*a* and 235*b* may include check valves 258*a* and 258*b*, respectively. A manually operated bleed valve 260 may be connected between pressure relief lines 235*a* and 235*b* and vent line 252 to bleed off excess pressure in fill lines 234*a* and 234*b* to vent line 252.

Dispenser 205 may further include analog pressure gauges 248*a* and 248*b* for displaying pressure in fill lines 234*a* and 234*b*, respectively. Such gauges 248*a*, 248*b* provide a way to confirm the accuracy and calibration of the digital pressure sensors 246*a* and 246*b*.

Having generally described the basic structure of the LNG flow control components 210*a* of dispenser 205, reference is made to FIG. 2, which shows the electronic components 207 of dispenser 205.

As already mentioned, dispenser 205 includes dispenser controller 110; meters 244*a* and 244*b*; temperature sensor 270; pressure sensors 246*a* and 246*b*; fill valves 238*a*, 240*a*, 242*a*, 238*b*, 240*b*, and 242*b*; and optional actuator valves 239*a*, 241*a*, 243*a*, 239*b*, 241*b*, and 243*b*. Dispenser controller 110 may comprise one or more of: microprocessors or equivalents thereof, programmed logic arrays, digital-to-analog converters, analog-to-digital converters, clocks, memory, buffers, and any other analog or digital circuitry to perform the functions described herein.

Dispenser 205 further includes a communication interface 112 that enables controller 110 to send and receive communications to and from a control console 200 that may control the pressure banks of a natural gas farm. According to one embodiment, the communication interface 112 and control console 200 may be coupled to one another through a network and communicate with one another using a PLC communication protocol. An example of a preferred protocol is disclosed in U.S. Provisional Application No. 61/793,256, entitled "IMPROVED FUEL DISPENSERS" filed on Mar. 15, 2013 by Sarah Ann Lambrix et al., the entire disclosure of which is incorporated herein by reference.

Figure 4:
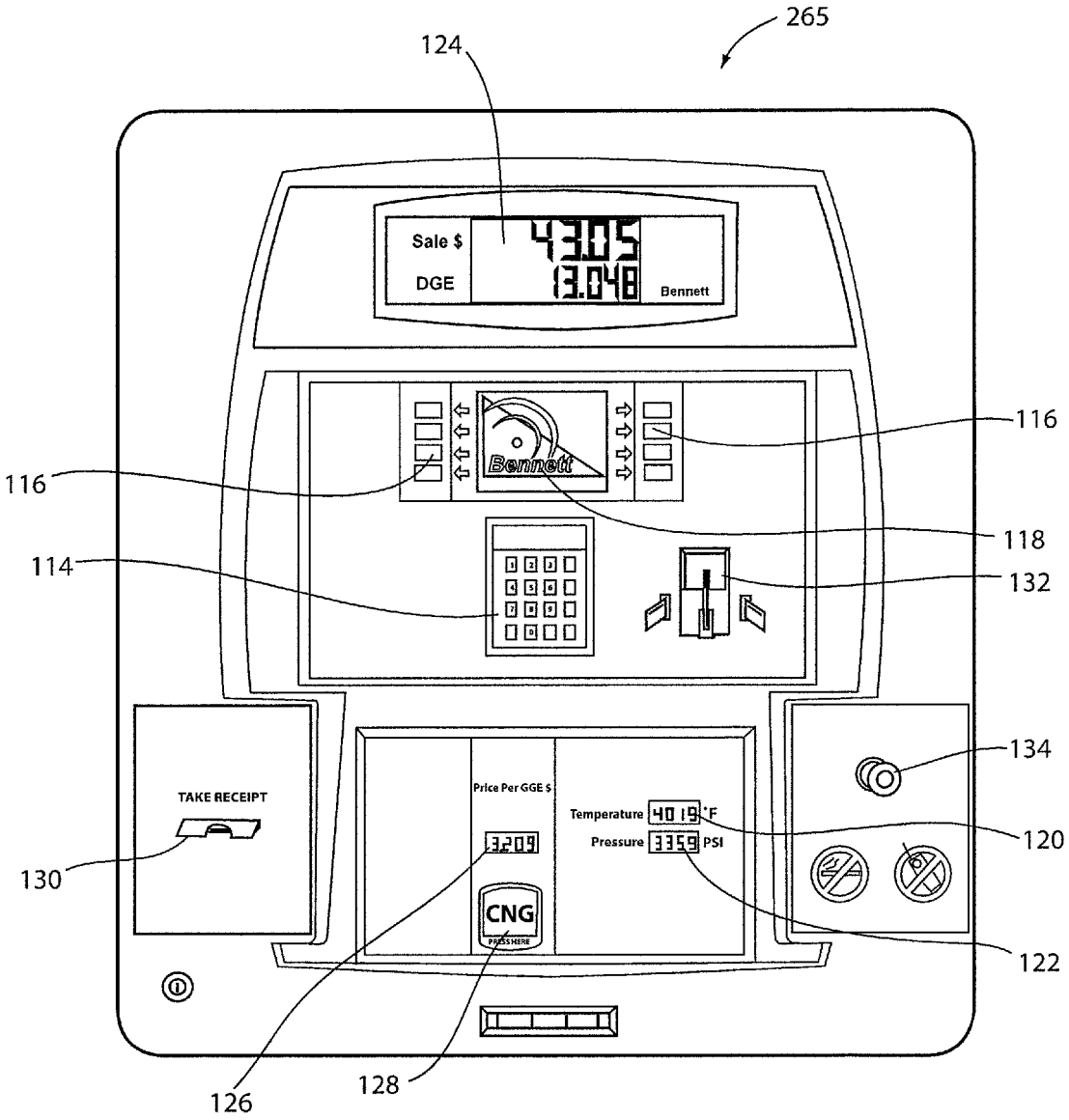
FIG. 4 is an elevational view of a close-up of a portion of the front of the CNG dispenser of FIG. 3.

As also shown in FIGS. 3 and 4, dispenser 205 may further include the aforementioned fill hoses 230*a* and 230*b*, fill nozzles 232*a* and 232*b*, and a user interface section 265 including a user interface keyboard or numeric keypad 114, user interface buttons 116, a dispenser display 118, an ambient temperature display 120, a pressure display 122, a sale/GGE display 124, one or more grade selection displays 126, one or more optional grade selection buttons 128, a receipt printer 130, a card reader 132, and a stop button 134. User interface buttons 116 are preferably capacitive touch switches to reduce the risk of a spark. Buttons 116 and dispenser display 118 are multifunctional. A duplicate user interface section 265 may be provided on the other side of dispenser 205 for use by a user operating fill hose 230*b*.

Figure 5:
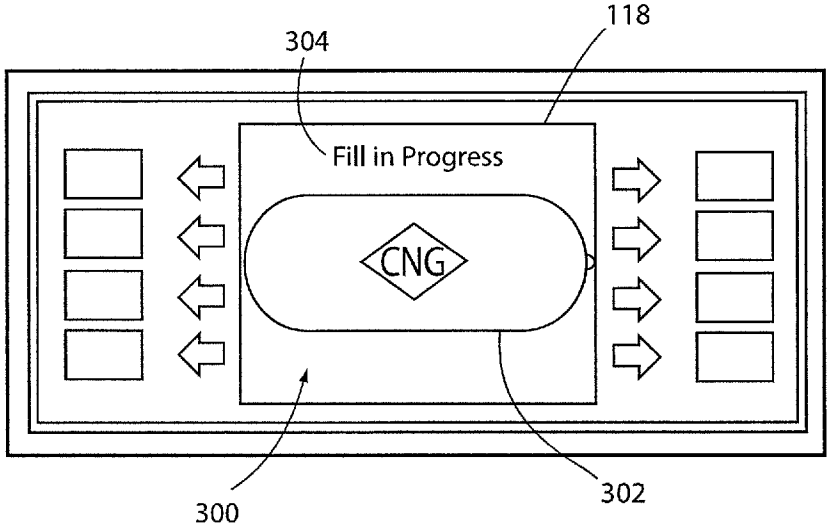
FIG. 5 is an elevational view of a display of the CNG dispenser of FIG. 3 showing a graphic fill indicator.

Controller 110 may control display 118 to show graphic displays. One such graphic display is a fill indicator bar, which displays the relative levels at which the vehicle tank is filled based upon the sensed pressure relative to the desired pressure. FIG. 5 shows an example of such a graphic fill indicator display 300. The graphic fill indicator display 300 includes a graphic representation of a vehicle CNG tank 302 and may include a textual message 304. When a fill is in progress, the tank graphic 302 is initially all colored white representing an empty tank. The textual message 304 may read "Fill in Progress." As the vehicle tank fills, the tank graphic 302 shown on display 118 gradually changes in color from white to blue from the bottom of the tank upward to an extent proportional to the amount the vehicle tank is filled. For example, when the vehicle tank is half filled (as determined by the pressure of the tank relative to the selected pressure), tank graphic 302 is colored such that the bottom half is blue. When the vehicle tank is full, the tank graphic 302 turns all green and the textual message 304 reads "Full Fill."

In addition, display 118 may be used to display graphic training illustrations such as those disclosed in U.S. Provisional Application No. 61/793,256, entitled "IMPROVED FUEL DISPENSERS" filed on Mar. 15, 2013 by Sarah Ann Lambrix et al., the entire disclosure of which is incorporated herein by reference.

Pressure display 122 is provided to display the pressure of the CNG fuel as sensed by a corresponding pressure sensor 246*a* or 246*b*.

Sale/GGE display 124 is provided to display the sale cost (in dollars) and the gasoline gallon equivalent (GGE) or mass in pounds or kilograms of the CNG dispensed to the vehicle tank as measured by a corresponding meter 244*a* or 244*b*. The GGE information may be displayed on an alternative existing display of dispenser such as displays 118, 120,122, and 126 or on an additional display. Stop button 134 is provided for initiating an emergency stop.

Dispenser 205 may further include an optional gas sensor 138, a boot nozzle sensor 140, and a fresh air purge system 142.

Gas sensor 138 is provided for sensing methane gas in the environment outside the dispenser cabinet. If gas is sensed, controller 110 performs a shutdown procedure at least until such time that gas is no longer sensed. This is an improvement over prior systems where a gas sensor was coupled to a remote controller that would shut down the dispenser in a less than orderly manner.

Boot nozzle sensor 140 senses when the nozzle 232*a*, 232*b* is inserted in a nozzle boot 274 and provides this information to controller 110. In essence, boot nozzle sensor 140 serves as an on/off switch. Nozzle boot 274 may also include a locking mechanism for locking nozzle 232*a* or 232*b* in nozzle boot 274 when the dispenser is not operational.

Fresh air purge system 142 is provided in the upper chamber of the dispenser cabinet where the electrical components 207 are located to purge the air in this chamber with fresh air. This maintains a positive pressure in the electrical chamber, which keeps any methane gas from reaching the electrical components.

Figure 6:
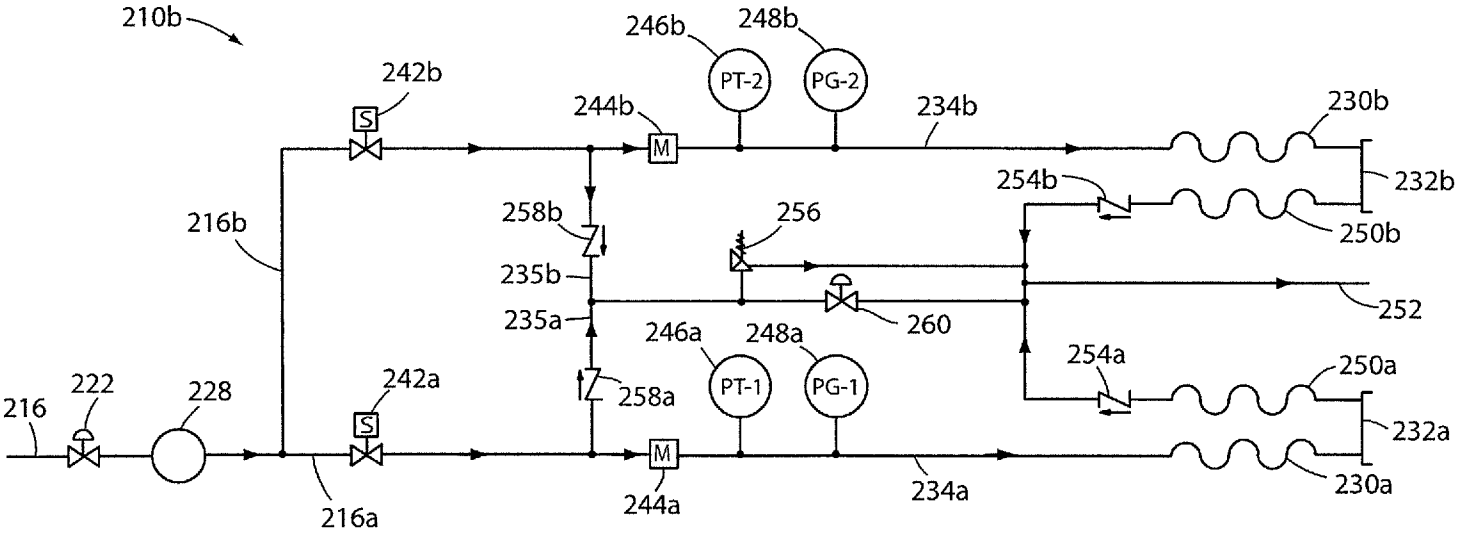
FIG. 6 is a hydraulic flow diagram in schematic form of CNG flow control components of a dispenser according to an alternative embodiment.

Components 210*b* of a second embodiment of a CNG dispenser are shown in FIG. 6, which is designed for a one-pressure bank system where a vent line 252 and only a high pressure supply line 216 are provided. In this embodiment, some of the components are eliminated and the remaining components are the same as those mentioned above. In essence, the second embodiment eliminates supply lines 212 and 214, main shut off valves 218 and 220, filters 224 and 226, fill valves 238*a*, 238*b*, 240*a*, and 240*b*, and manifolds 236*a* and 236*b*.

In operation, controller 110 simply fills from a high pressure supply line (i.e., 4000 psi) by opening valve 242*a* or 242*b* depending on which fill hose 230*a* or 230*b* is being used, and keeping the valve open while monitoring the pressure reading from the corresponding pressure sensor 246*a* or 246*b* until the selected pressure is reached at which point controller 110 closes valve 242*a* or 242*b* and completes the sale.

Although the second embodiment does not provide the advantage of being capable of being used with a three-bank system, it still provides all of the other novel features and thus benefits from their advantages.

Although both of the above embodiments above show dispensers with two fill hoses, the various aspects of the present invention may be implemented in dispensers having one fill hose or dispensers having more than two fill hoses. Examples of two embodiments having four fill hoses (two per side) are shown in FIGS. 7 and 8 and described further below.

Figure 7:
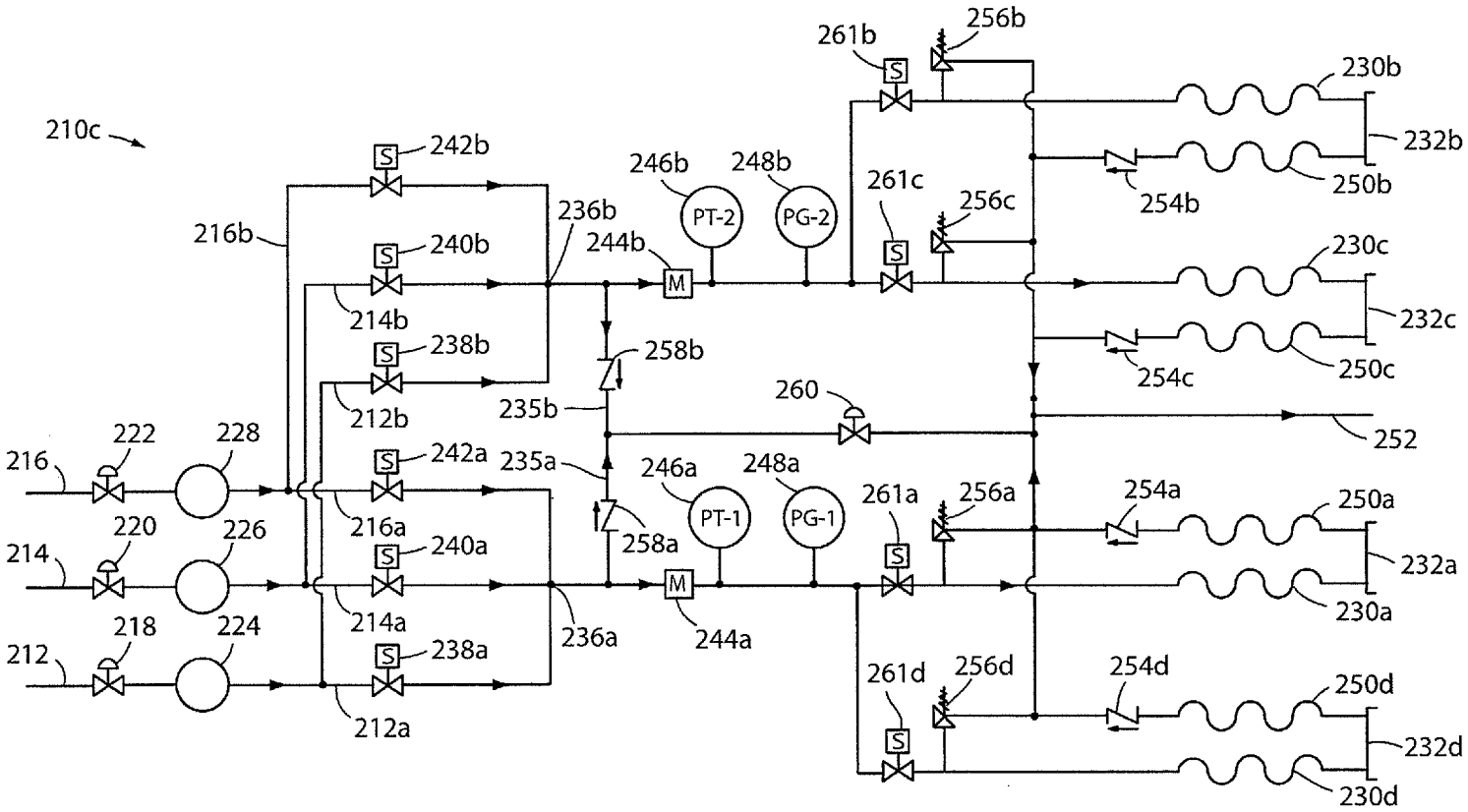
FIG. 7 is a hydraulic flow diagram in schematic form of CNG flow control components of a dispenser according to an another alternative embodiment.

In the embodiment shown in FIG. 7, all of the components are identical to the embodiment shown in FIG. 1 except that the components 210*c* of the embodiment shown in FIG. 7 include the following additional components: a third fill hose 230*c*, a third nozzle 232*c*, a third vent hose 250*c*, a third check valve 254*c*, a fourth fill hose 230*d*, a fourth nozzle 232*d*, a fourth vent hose 250*d*, a fourth check valve 254*d*, first, second, third, and fourth pressure relief valves 256*a*, 256*b*, 256*c*, and 256*d*, and first, second, third, and fourth hose selection valves 261*a*, 261*b*, 261*c*, and 261*d*. First and third pressure relief valves 256*a* and 256*c* may be configured to vent at about 3750 psi, whereas second and fourth pressure relief valves 256*b* and 256*d* may be configured to vent at about 4000 psi.

In the embodiment shown in FIG. 7, the system operates similar to the embodiment of FIG. 1 except that for each side of dispenser, a fill hose is provided for delivering CNG at 3000 psi (first and third fill hoses 230*a* and 230*c*) and a fill hose is provided for delivering CNG at 3600 psi (second and fourth fill hoses 230*b* and 230*d*). Accordingly, controller 110 controls hose selection valves 261*a* and 261*d* to open one of those valves and close the other valve depending upon the pressure selected by the user so that CNG is delivered to the appropriate one of fill hoses 230*a* and 230*d* corresponding to the selected pressure. Controller 110 similarly controls hose selection valves 261*b* and 261*c* to select to which fill hose 230*b* or 230*c* to deliver CNG associated with the user selected pressure. This allows different nozzles to be used for different pressures.

Figure 8:
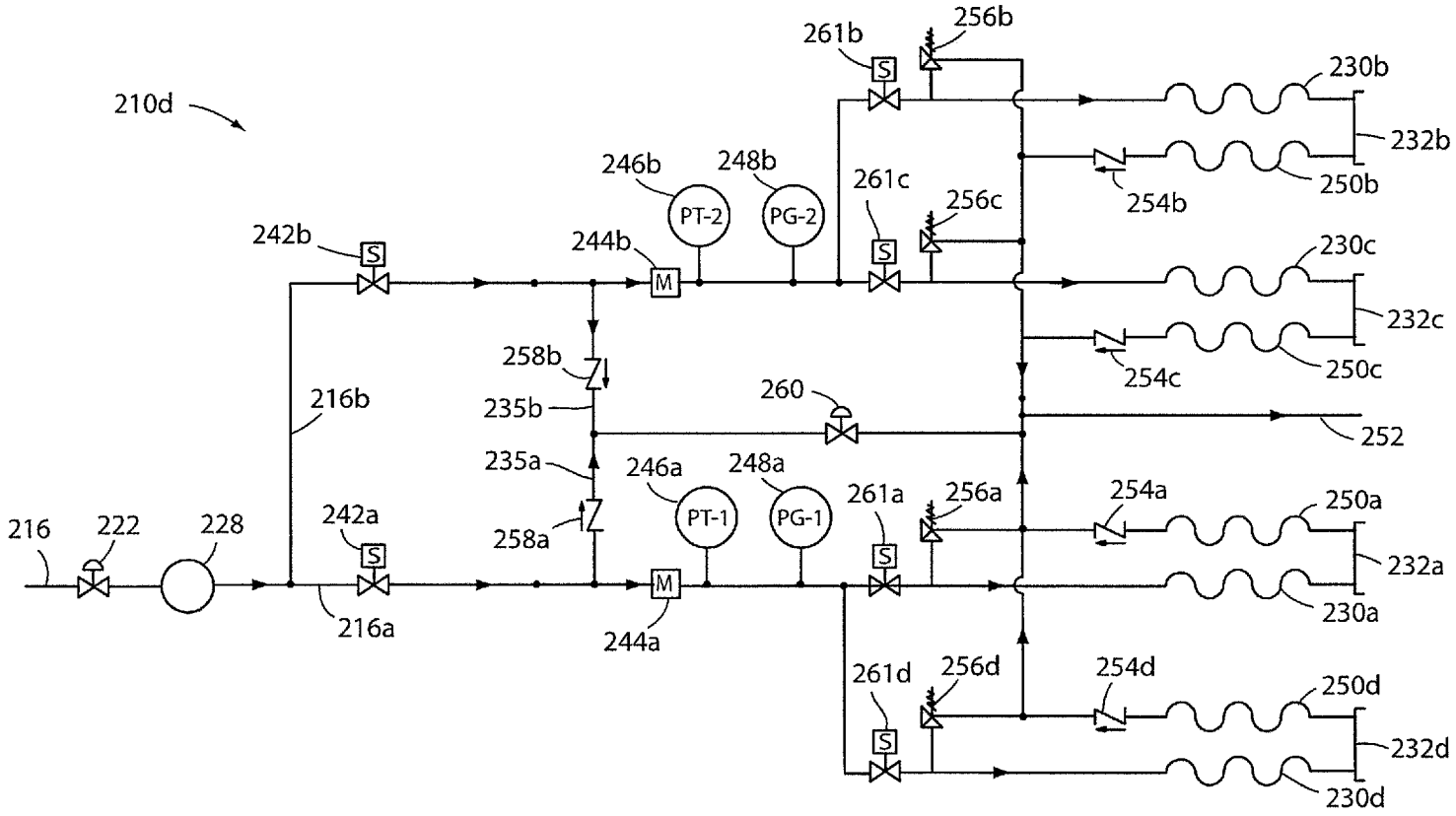
FIG. 8 is a hydraulic flow diagram in schematic form of CNG flow control components of a dispenser according to another alternative embodiment.

In the embodiment shown in FIG. 8, all of the components are identical to the embodiment shown in FIG. 6 except that the components 210*d* of the embodiment shown in FIG. 8 includes the following additional components: a third fill hose 230*c*, a third nozzle 232*c*, a third vent hose 250*c*, a third check valve 254*c*, a fourth fill hose 230*d*, a fourth nozzle 232*d*, a fourth vent hose 250*d*, a fourth check valve 254*d*, first, second, third, and fourth pressure relief valves 256*a*, 256*b*, 256*c*, and 256*d*, and first, second, third, and fourth hose selection valves 261*a*, 261*b*, 261*c*, and 261*d*. First and third pressure relief valves 256*a* and 256*c* may be configured to vent at about 3750 psi, whereas second and fourth pressure relief valves 256*b* and 256*d* may be configured to vent at about 4000 psi.

In the embodiment shown in FIG. 8, the system operates similar to the embodiment of FIG. 6 except that for each side of dispenser 205, a fill hose is provided for delivering CNG at 3000 psi (first and third fill hoses 230*a* and 230*c*) and a fill hose is provided for delivering CNG at 3600 psi (second and fourth fill hoses 230*b* and 230*d*). Accordingly, controller 110 controls hose selection valves 261*a* and 261*d* to open one of those valves and close the other valve depending upon the pressure selected by the user so that CNG is delivered to the appropriate one of fill hoses 230*a* and 230*d* corresponding to the selected pressure. Controller 110 similarly controls hose selection valves 261*b* and 261*c* to select to which fill hose 230*b* or 230*c* to deliver CNG associated with the user selected pressure. This allows different nozzles to be used for different pressures.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the claims as interpreted according to the principles of patent law, including the doctrine of equivalents.

What is claimed is:

1. A CNG dispenser comprising:

a cabinet;

a fill hose extending from said cabinet;

a pressure sensor disposed to sense a pressure within said fill hose that corresponds to a pressure of a vehicle tank when said fill hose is coupled to the vehicle tank;

a controller coupled to said pressure sensor for monitoring the pressure and determining a target pressure at which the vehicle tank is to be filled, said controller further determining levels at which the vehicle tank is filled based upon a sensed pressure of the vehicle tank relative to the target pressure; and a graphic display coupled to said controller for displaying a fill indicator bar, which graphically displays the relative levels at which the vehicle tank is filled relative to the target pressure.

2. The CNG dispenser of claim 1 and further comprising:

a high pressure fill valve disposed between a high pressure CNG supply line and said fill hose; and at least one user-actuatable button disposed on said cabinet for allowing a user to select the target pressure to which to fill the vehicle tank with CNG, wherein said controller is further coupled to said at least one user-actuatable button and said high pressure fill valve for opening said high pressure fill valve to dispense high pressure CNG into the vehicle tank while monitoring the pressure of the vehicle tank as sensed by said pressure sensor until the pressure reaches the user-selected target pressure.

3. The CNG dispenser of claim 1, wherein said fill indicator bar includes a graphic illustration of a vehicle fuel tank that gradually changes color from a bottom to a top as the vehicle fuel tank is filled.

4. The CNG dispenser of claim 1, and further comprising an ambient temperature sensor for reading an ambient temperature of the outside air surrounding the dispenser and supplying the temperature data to said controller, wherein said controller adjusts the target pressure to which the vehicle tank is to be filled in response to the temperature data.

5. A fuel dispenser comprising:

a cabinet;

a fill hose extending from said cabinet;

a pressure sensor disposed to sense a pressure within said fill hose that corresponds to a pressure of a vehicle tank when said fill hose is coupled to the vehicle tank;

a controller coupled to said pressure sensor for monitoring the pressure and determining a target pressure at which the vehicle tank is to be filled with fuel, said controller further determining levels at which the vehicle tank is filled based upon a sensed pressure of the vehicle tank relative to the target pressure; and a graphic display coupled to said controller for displaying a fill indicator bar, which graphically displays the relative levels at which the vehicle tank is filled with fuel relative to the target pressure.

6. The fuel dispenser of claim 5 and further comprising:

a high pressure fill valve disposed between a high pressure CNG supply line and said fill hose; and at least one user-actuatable button disposed on said cabinet for allowing a user to select the target pressure to which to fill the vehicle tank with CNG, wherein said controller is further coupled to said at least one user-actuatable button and said high pressure fill valve for opening said high pressure fill valve to dispense high pressure CNG into the vehicle tank while monitoring the pressure of the vehicle tank as sensed by said pressure sensor until the pressure reaches the user-selected target pressure.

7. The fuel dispenser of claim 5, wherein said a fill indicator bar includes a graphic illustration of a vehicle fuel tank that gradually changes color from a bottom to a top as the vehicle fuel tank is filled.

8. The fuel dispenser of claim 5, and further comprising an ambient temperature sensor for reading an ambient temperature of the outside air surrounding the dispenser and supplying the temperature data to said controller, wherein said controller adjusts the target pressure to which the vehicle tank is to be filled in response to the temperature data.

* * * * *